US005992690A

United States Patent [19]

Tracy

[11] Patent Number: 5,992,690

[45] Date of Patent: Nov. 30, 1999

[54] FLUID METERING SYSTEM WITH QUICK DISCONNECT AND AIR GAP INDUCTOR

[75] Inventor: James M. Tracy, Fridley, Minn.

[73] Assignee: Minuteman International, Inc., Addison, Ill.

[21] Appl. No.: 09/122,928

[22] Filed: Jul. 27, 1998

Related U.S. Application Data

[60] Provisional application No. 60/054,190, Jul. 30, 1997.

[51] Int. Cl.[6] ..... A63H 3/18

[52] U.S. Cl. ..... 222/79; 222/145.5; 222/630; 222/567; 239/600

[58] Field of Search ..... 222/7–9, 145.1, 222/145.5, 145.6, 567, 630, 637; 239/600

[56] References Cited

U.S. PATENT DOCUMENTS

| | | | |
|---|---|---|---|
| 5,190,224 | 3/1993 | Hamilton | 239/600 |
| 5,337,930 | 8/1994 | Fah et al. | 222/630 |
| 5,351,890 | 10/1994 | Clements | 222/637 |
| 5,429,308 | 7/1995 | Brown | 239/600 |
| 5,727,713 | 3/1998 | Kateman et al. | 222/145.6 |
| 5,727,739 | 3/1998 | Hamilton | 239/600 |
| 5,816,446 | 10/1998 | Steindorf et al. | 222/145.6 |

*Primary Examiner*—Joseph A. Kaufman
*Attorney, Agent, or Firm*—Emrich & Dithmar

[57] ABSTRACT

A delivery system for chemical concentrates, each in a separate container, includes, for each concentrate, a quick-disconnect coupling for a hand-operated valve connected to a pressurized water supply line. The coupling is connected to an air gap inductor including a mixing chamber into which the concentrate is metered. The diluted concentrate is then supplied to a user vessel or directly to a machine reservoir.

5 Claims, 4 Drawing Sheets

FLUID METERING SYSTEM WITH QUICK DISCONNECT AND AIR GAP INDUCTOR

RELATED APPLICATION

This application claims the benefit of the filing date of co-pending U.S. Provisional Application No. 60/054,190, filed Jul. 30, 1997.

BACKGROUND AND SUMMARY OF THE INVENTION

The present invention relates to apparatus for metering liquid in concentrate form from a container, and diluting it with water from a convenient, pressurized source, such as a pressurized utility water supply line commonly available in commercial, industrial and residential buildings.

Typically, industrial and commercial cleaning systems include a number of different chemical cleaners, each provided in a separate container in concentrate form. The chemicals in concentrate form may include a surface cleaner, commonly referred to as a "spray and wipe" cleaner, a floor cleaner, a degreaser, or a rug shampoo, as well as many others. There may be a different combination of chemicals particularly suited for different application situations. For example, the chemical concentrate sources for a hospital might be different than the combination of chemical concentrate sources for a contract commercial cleaning service, or a fast food restaurant. Thus, an ability to accommodate many different combinations of source containers is an important advantage of any metering or diluting system.

It is also desirable to avoid cross-contamination between one cleaner concentrate and another, as might occur if the same metering device is used to draw chemicals from different source containers simply by moving a single concentrate tube from one concentrate source container to another concentrate source container, using the same source of pressurized water.

It is also desirable to avoid any backflow of cleaner concentrate or other chemicals into the source of water, and this is conventionally provided by an induction device which, includes an isolating air gap upstream of a mixing chamber. The inductor syphons the concentrate through a metered, concentrate tube and into the mixing chamber, from which the mixture is disposed through a flexible delivery tube. The air gap is provided in the inductor upstream of the mixing chamber so that only water from the source under pressure can pass through the air gap; and concentrate or even diluted chemicals cannot pass from the mixing chamber upstream to the source of water.

It is also desirable to permit the operator to form a solution from a number of different concentrates quickly and reliably using a single source of pressurized water. The user may quickly yet reliably disconnect one concentrate from the water source and connect another concentrate without having to use tools or to "break" a threaded connection between male and female threaded members.

The present invention provides all of the above-mentioned advantages and, in some embodiments, adds still another advantage—namely, it permits the operator to actuate or stop the source of pressured water very quickly, without having to turn a threaded valve or other member, to provide convenience and accuracy in preparing the desired quantity of diluted cleaning chemical. As used herein, the terms "cleaning chemical" and "concentrate" are intended to be broadly construed to include all such chemicals as are normally provided in concentrate form and diluted prior to use by maintenance or cleaning personnel. Typically, such chemicals may include a general purpose cleaner/disinfectant, surface cleaner for windows, glass and other glossy surfaces, a heavy-duty cleaner for removing soap film, a foaming acid shower treatment for removing hard water scale and soap scum, a floor cleaner for daily use, a general purpose cleaner for water washable surfaces, degreasers, strippers, sanitizers, odor control agents, foaming degreasers, carpet extraction cleaners, carpet spotting and pre-spraying cleaners, dishwater liquid detergent, hard water cleaners and many others.

Other features and advantages of the present invention will be apparent to persons skilled in the art from the following detailed description of a preferred embodiment accompanied by the accompanying drawing where identical reference numerals will refer to like parts in the various views.

DETAILED DESCRIPTION OF A PREFERRED EMBODIMENT

Figure 1:
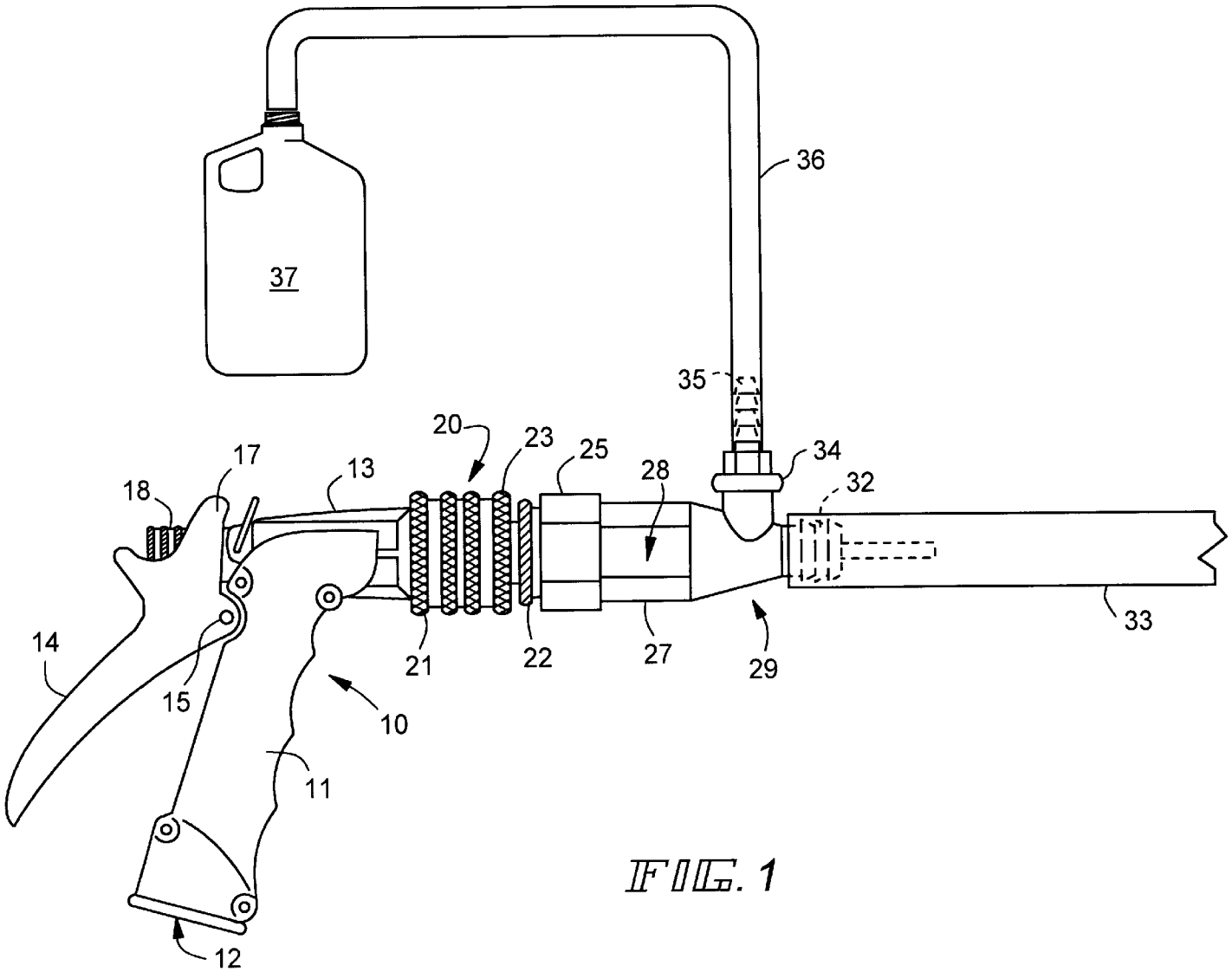
FIG. 1 is a side elevational view of an apparatus constructed according to the present invention.

Turning first to FIG. 1, reference numeral 10 generally designates a conventional trigger sprayer control commonly used for connecting flexible garden hoses to an outlet such as a spray nozzle. The sprayer control 10 includes a hand-operated trigger valve. The sprayer control 10 includes a grip or handle 11, including an inlet 12 which is threaded to receive a coupling of a common garden hose with mating threads. The hose may be of any desired length; and the other end of the hose includes a female threaded coupling for connecting to a conventional source of pressurized water generally available, such as a faucet connected to a water supply line. The instant invention includes a number of different threaded connections, each including a male part (which typically is externally threaded) and a female part (typically internally threaded). Persons skilled in the art will appreciate that the relationship of male and female may be interchanged without effecting the operation of the system, although it may affect the convenience to the user in some cases. The same is true for quick disconnect connections.

Figure 2:
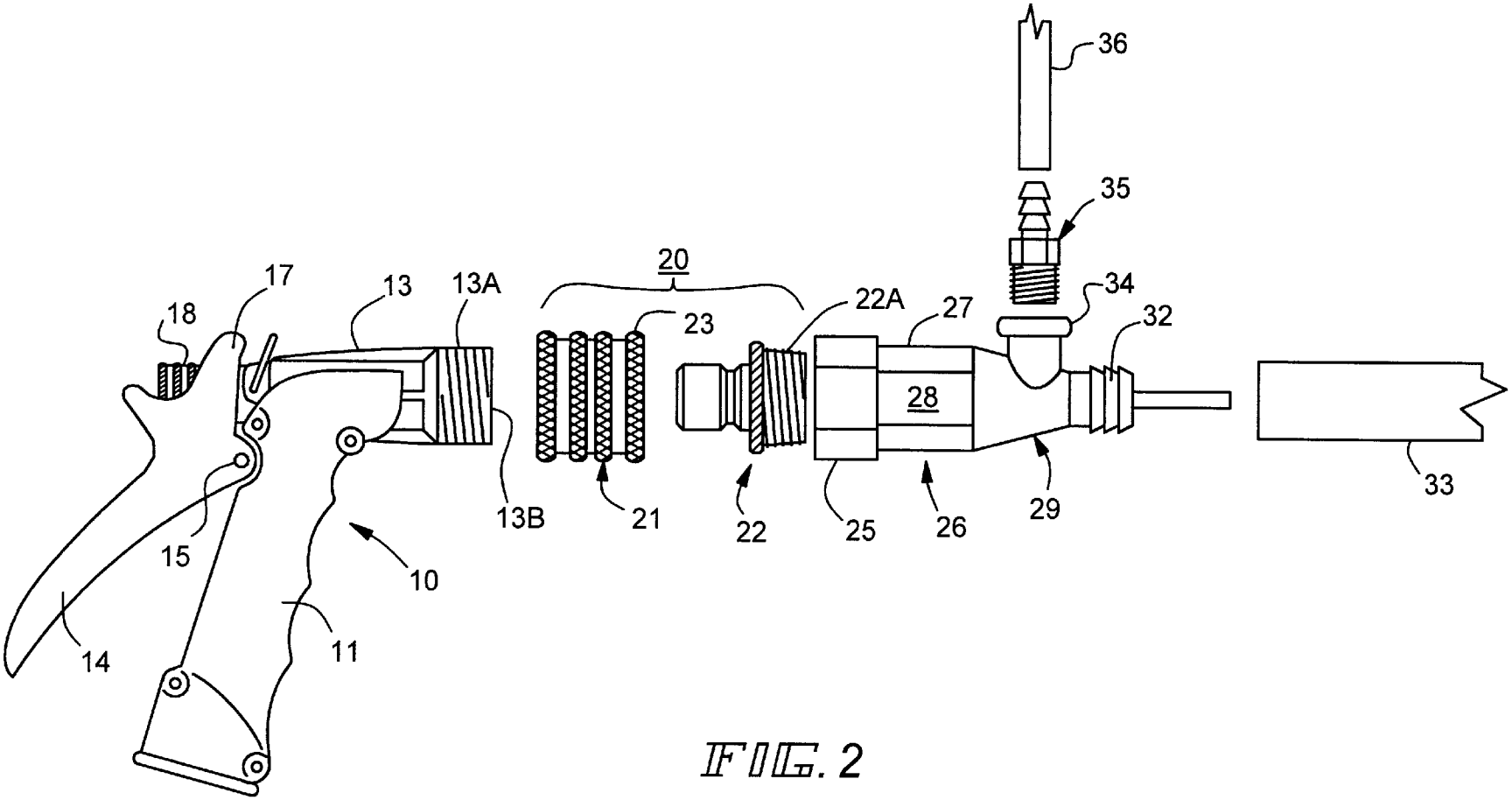
FIG. 2 is a view similar to FIG. 1 with the components (other than the source container) shown in exploded relation.

At the upper end of the hand grip 11 is a valve housing 13 which has external threads (13A in FIG. 2) to form a male connector. A discharge outlet 13B is formed in the housing 13. An actuator or trigger member 14 is pivotally connected at 15 to the hand grip 11 of the control; and it includes an extension 17 which is coupled to a valve stem 18 extending rearwardly of the valve housing 13. A conventional valve mechanism is housed within the housing 13 of the control; and the valve is opened when the trigger member 14 is pressed toward the grip 11 by the operator, thereby rotating the trigger member 14 counterclockwise about the pivot 15 and moving the valve stem 18 toward the left in FIG. 1. This provides a flow of pressurized water through the housing 13 and discharge opening 13B (FIG. 2).

In the drawing, a hand-operated control valve (the conventional sprayer control 10) is illustrated. Other valve controls may equally conveniently be employed. For example, a finger-actuated spool valve or other mechanically operated push valves may be used. Further, the control valve may be a conventional laundry faucet having a male threaded connector at the spigot so that the hand-operated faucet valve may be used to provide water from a pressurized water supply line such as conventionally supplies a sink or a utility spigot. It is convenient to have the source control mechanism be hand-operated under the control of the user, whether control be by turning, pushing or squeezing.

Coupled to the outlet of the housing 13 is a quick disconnect assembly generally designated 20 including a female coupling member or element 21 and a male coupling element 22. The left end of the female coupling element 21 is threadedly coupled to the discharge end of the housing 13 of the control valve 11; and the female and male coupling members 21, 22 of the quick disconnect assembly shown in FIG. 1 are assembled together in sealing relation in a conventional manner. In FIG. 2, the two elements are separated. The female member includes a spring-biased release portion 23 which, when moved by hand toward the left in FIG. 1, releases the male coupling member 22 and permits disconnection without unscrewing, as seen in FIG. 2 and known in the art.

The male coupling member 22 of the quick disconnect assembly 20 includes a male threaded member 22A which is received into an internally threaded collar 25 of an air gap inductor generally designated 26.

The male and female members of the quick disconnect assembly 20 could be reversed, with appropriate fittings to be attached to the source valve 10 and inductor 26 respectively. Extending to the right (i.e., downstream) of the collar 25 the air gap inductor 26 also includes an air gap structure 27 which defines an air gap 28 in the path of the water stream from the source. The water passes through the air gap 28 into a mixing chamber generally designated 29 which has a progressively reducing cross section in the direction of flow and leads to a barbed outlet connector 32 on which there is placed a delivery conduit 33, which may be flexible or rigid. The delivery conduit 33 may be used to fill a pail or other convenience tote container, or it may be used to fill a reservoir for a floor care machine. The mixing chamber 29 also has a concentrate inlet port 34 which threadedly receives a barbed inlet adapter 35 for receiving a flexible conduit 36 connected to a container or reservoir of concentrate designated 37 in a conventional manner. The adapter 35 may form a right angle as seen in the embodiment of FIG. 3 at 35A, or other angle, if convenience is suited.

Metering of the concentrate may be provided in any number of conventional ways, including having a metering orifice (sometimes called a "proportioning tip") in the cap of the source container or in the feed conduit 36 from the concentrate container or by including a metering orifice in the inlet port 34 of the inductor.

The inductor 26, male coupling 22 of the quick disconnect coupling 20, discharge conduit 33, concentrate conduit 36, concentrate container 37, check valve 50 and metering orifice (proportioning tip) provide the primary components of a mixing/delivery assembly associated with a single concentrate and a single dilution ratio. A separate mixing/delivery assembly similar to the mixing/delivery assembly already described, and including (i) an inductor, (ii) one mating coupling of a quick disconnect coupling, (iii) discharge conduit and (iv) concentrate flow assembly, including source container, check valve, metering orifice and feed conduit is provided for each individual concentrate as well as for different desired concentrations of a specific concentrate.

Figure 3:
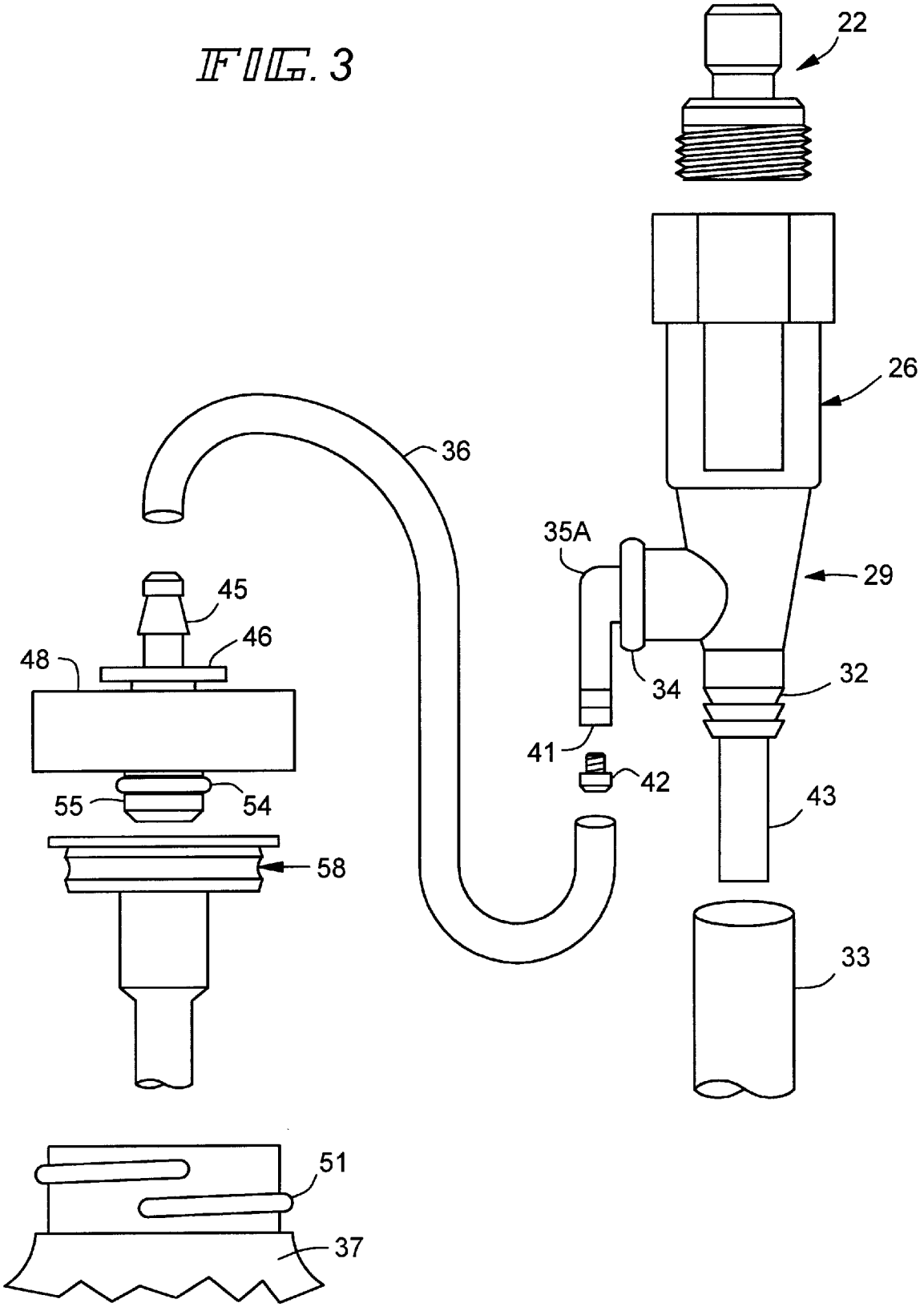
FIG. 3 is a side elevational view of the apparatus of FIG. 2 with a source container and feed system for a single chemical concentrate.

Turning now to FIG. 3, a more complete system (which includes only one mixing/delivery assembly) is shown. In FIG. 3, the male quick-disconnect coupler 22, inductor 26 and discharger conduit 33 are repeated. The elements are shown in exploded relation, and the hand actuatable water source valve, source of water and container into which the diluted mixture is placed, are not repeated for brevity.

Connected to the inlet port 34 of the inductor 26 is a 90° or right-angle hose connector 35A has an inlet end at 41 which receives a conventional proportioning tip 42. The proportioning tip 42 has a metering orifice formed therein of a specific diameter so that it accurately meters the chemical from the source container 37 through the venturi action of the air-gap inductor 26 which suctions the chemical to be diluted in a desired ratio into the mixing chamber of the inductor 26 and then delivers the mixture through the outlet extension 43 of the barbed adapter 32 into the previously described discharge conduit 33.

Figure 4:
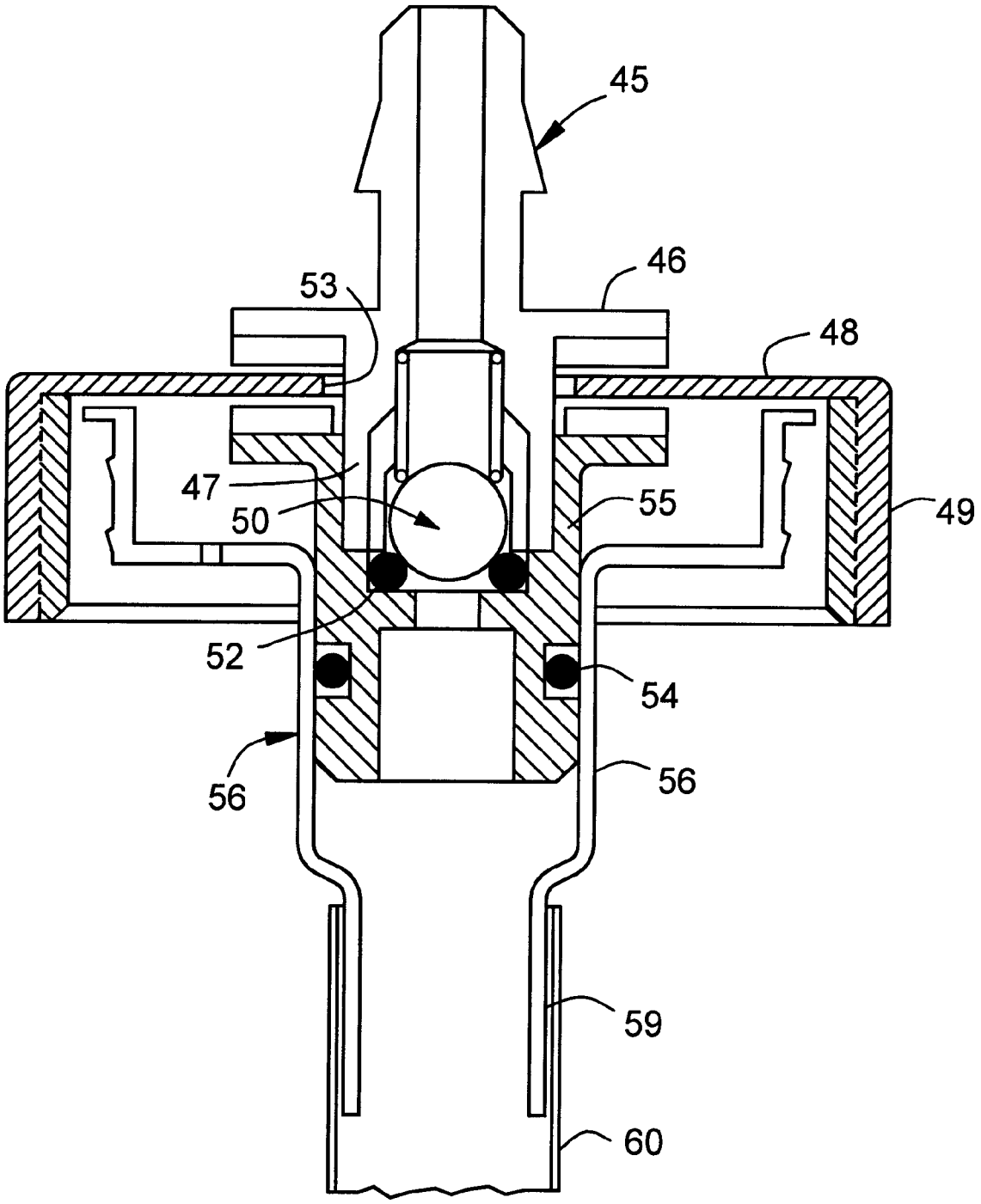
FIG. 4 is a vertical section view of the cap and valve for the source container.

The flexible hose or conduit 36 has one end received or clamped on the inlet end of the connector 35A; and it has its other end fit over an adapter 45. The adapter 45 may be barbed as indicated so that the flexible hose 36 is sealingly and securely assembled to the adapter. The adapter 45 includes a circular flange 46 which is spaced slightly above a cap 48 (FIGS. 3 and 4). The lower portion 47 of the adapter 46 extends below the top of the cap 48 to receive a conventional spring-biased check valve generally designated 50 in FIG. 4. The cap 48 may be of a rigid plastic, and it includes a sidewall 49 having interior threads for receiving the exterior threads of a neck 51 of a source container 37 for the concentrated chemical being diluted and metered.

The check valve 50 is a conventional one-way valve which permits the liquid contents of the container 37 to travel only from the container to the inductor, and prevents flow back to the container by having a ball seated on an O-ring 52. The male adapter 45 is loosely received in an aperture 53 in the top of the cap 48 so that make-up air may flow between the flange 46 and the top of the cap 48 into the interior of the source container 37 as its contents are dispensed and consumed.

The mating bottom portion 55 is assembled to the lower portion 47 of the adapter 45; and it is provided with an O-ring 54 which is received in an enlarged extension 56 of a bottle insert 58. A lower portion 59 of the insert 58 forms an extension receiving a flexible plastic conduit 60 (FIG. 4) sometimes referred to as a "straw" or dip tube since it is used to suction the contents of the bottom of container 37. The upper portion of the dip tube 60 fits over the downward extension 59 of bottle insert 58.

In operation, as water is forced through the inductor 26 from the source, it passes through the air gap into the mixing chamber where it creates a low pressure. Suction created in the mixing chamber draws the liquid contents of the source container 37 through the dip tube 60, check valve 50, adapter 45 and the flexible conduit 36, and then through the proportioning tip 42 into the hose connector 35A (or 35) and into the mixing chamber 29.

Each container of concentrate is provided with its own delivery and mixing apparatus as shown in FIG. 3—namely, its own dip tube, bottle insert, removable cap, one-way valve and male adapter, flexible feed hose, proportioning tip, inductor, discharge conduit and one mating member of a quick-disconnect coupler.

In its broader aspects, the invention is not limited to the use of the cap assembly described above. The cap provides some convenience and protection against spillage, but an alternative embodiment providing some cost savings could have the flexible feed tube or conduit be lengthened and provided at its intake orifice with a conventional check valve. The conduit would pass directly into the concentrate container for take-up of concentrate without a cap on the container or bottle. The feed conduit might be supported on the neck of the container or a frame supporting the container for stability. Such a system would still have the advantages of protecting against source contamination with an air gap inductor, avoidance of cross-contamination of concentrates, and a quick and easy disconnect from one concentrate to another using the same water source. In both cases, the flow path from the concentrate container includes a check valve, delivery conduit and proportioning tip or other metering device, and is connected to feed into the mixing chamber of an air gap inductor.

Thus, the water supply line which is provided with the other mating member of the quick-disconnect coupler, is free of reverse flow of the chemical concentrate being dispensed (due to the action of the air gap of inductor 26). The delivery apparatus for one chemical concentrate may be removed quickly and easily; and the source valve and female member of the quick-disconnect coupling in the illustrated embodiment are then used to provide pressurized water to meter and dispense a different chemical or a different concentration of the same chemical. Thus, not only is contamination of the water source prevented, but cross-contamination of different chemicals (or concentrate) is prevented. As mentioned, if it is desired to have one container of a chemical concentrate to be dispensed at one dilution ratio, and the same chemical also dispensed at a second dilution ration, there may be two different sources, portioning tips and inductors, one complete set of source, delivery and metering apparatus for each proportioning ratio. This will provide reliability and avoid mistakes.

The above system has the advantage that a user can have any number of different sources of concentrate, each set up with its own proportioning tip to provide a desired final concentration of chemical in a use receptacle, such as a bucket or a reservoir of a floor care machine, with each chemical having its own air gap inductor and a male quick disconnect coupling. This will reduce error on the part of the user who need not concern himself or herself with locating and changing the metering orifice, and it also insures that every source chemical is provided with an air gap to avoid cross contamination and source contamination. It also facilitates assembly of the concentrate to all sources of water typically found at a user's facility. Finally, it permits the operator to visually observe the production of the diluted cleaning material while having convenient access to a hand-actuated valve permitting the user to make only as much of the diluted cleaning material as is desired or needed.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. Apparatus for using a source of pressurized water having a user-actuatable valve and one mating member of a quick-disconnect coupling, to dilute a chemical concentrate from one of a plurality of source containers of chemical concentrate, said apparatus comprising, for each concentrate:

a source container for a concentrate;

a second mating member of said quick-disconnect coupling for coupling with said one mating member of said quick disconnect coupling;

an air gap inductor connected to said second mating member of said quick disconnect coupling, said inductor having a mixing chamber, an inlet into said mixing chamber for said concentrate, and an outlet;

a delivery tube coupled to said outlet of said inductor for delivering mixed, diluted concentrate;

a feed path from said source container to said mixing chamber of said inductor, said feed path including:

feed conduit means having one end coupled to said inlet of said mixing chamber of said inductor and another end adapted to be immersed in said concentrate;

means of defining a metering orifice for metering the amount of concentrate flowing through said feed conduit into said mixing chamber; and a check valve for permitting said concentrate to flow from said source container to said mixing chamber;

whereby suction created in said mixing chamber of said inductor will draw the metered concentrate from said source container into said mixing chamber.

2. The apparatus of claim 1 wherein said actuatable valve for said source of pressurized water comprises a nozzle spray assembly having a hand-actuated operating lever.

3. The apparatus of claim 1 characterized in that said air inductor includes an air space between said mixing chamber and said second mating member of said quick disconnect coupling to preclude backflow of said concentrate into the said source of water.

4. The apparatus of claim 1 wherein said apparatus further comprises a cap assembly for each said container, and said feed conduit means comprises a first feed conduit extending from said cap assembly to said mixing chamber, and a second conduit extending from said cap assembly and into fluid communication with said concentrate.

5. The apparatus of claim 4 wherein said cap assembly includes said check valve and provides an opening for make up air to pass into its associated source container as concentrate is drawn therefrom.

* * * * *